United States Patent [19]

Paseman

[11] 4,344,570

[45] Aug. 17, 1982

[54] APPARATUS FOR CLEANING THE INTERIOR OF TUBES

[76] Inventor: Richard R. Paseman, 5517 Newport, Houston, Tex. 77023

[21] Appl. No.: 176,999

[22] Filed: Aug. 11, 1980

[51] Int. Cl.[3] ..... B05B 3/04; B05B 3/18

[52] U.S. Cl. ..... 239/67; 91/52; 91/410; 92/85 A; 118/317; 134/167 C; 134/178; 239/99; 239/126; 239/187; 239/206; 239/239; 239/242; 239/DIG. 13

[58] Field of Search ..... 239/67, 99, 124, 126, 239/187, 225, 237, 239, 240, 242, 246, 263, 264, 204–206, DIG. 13; 118/306, 317, DIG. 10; 91/410, 52; 92/85 A, 13.6; 134/166 C, 167 C, 168 C, 169 C, 172, 178, 198

[56] References Cited

U.S. PATENT DOCUMENTS

| | | | |
|---|---|---|---|
| 620,224 | 2/1899 | Bubser . | |
| 1,017,389 | 2/1912 | Dickson | 92/85 A |
| 1,982,590 | 11/1934 | Church et al. . | |
| 2,245,575 | 6/1941 | Court . | |
| 2,494,380 | 1/1950 | Ellig . | |
| 2,699,224 | 1/1955 | Schmitz | 91/52 |
| 2,735,794 | 2/1956 | Pletcher . | |
| 2,869,570 | 1/1959 | Wilkerson | 91/52 |
| 3,246,660 | 4/1966 | Hammelmann . | |
| 3,246,847 | 4/1966 | Hammelmann . | |
| 3,269,659 | 8/1966 | Shelton et al. . | |
| 3,377,026 | 4/1968 | De Mart et al. . | |
| 3,516,385 | 6/1970 | Walling . | |
| 3,525,426 | 8/1970 | Miller . | |
| 3,589,388 | 6/1971 | Haneline, Jr. . | |
| 3,601,136 | 8/1971 | Marcham . | |
| 3,668,975 | 6/1972 | Nelson | 92/85 A |
| 3,672,628 | 6/1972 | Aanstad | 92/85 A |
| 3,736,909 | 6/1973 | Marangoni et al. . | |
| 3,791,583 | 2/1974 | Nunlist et al. . | |
| 3,794,051 | 2/1974 | Lee, Jr. et al. . | |
| 3,797,745 | 3/1974 | Haus . | |
| 3,817,262 | 6/1974 | Caradeur et al. . | |
| 3,901,252 | 8/1975 | Riebe . | |
| 3,903,912 | 9/1975 | Ice, Jr. et al. . | |
| 3,938,535 | 2/1976 | Cradeur et al. . | |
| 3,987,963 | 10/1976 | Pacht . | |
| 4,085,474 | 4/1978 | Murphy . | |
| 4,137,928 | 2/1979 | Sentell | 239/237 |

*Primary Examiner*—Robert B. Reeves
*Assistant Examiner*—Michael J. Forman
*Attorney, Agent, or Firm*—Pravel, Gambrell, Hewitt, Kirk & Kimball

[57] ABSTRACT

A forward motion arresting means is added to a fluid powered lance to reduce the harmful effect of the stopping of the lance forward motion. A plug member mounted on the lance mates with a body member within the housing to prevent fluid flow and reduce the lance forward motion. Rearward motion arresting is achieved by the addition of a reservoir portion which acts as a hydraulic stop in conjunction with the lance piston.

7 Claims, 2 Drawing Figures

APPARATUS FOR CLEANING THE INTERIOR OF TUBES

TECHNICAL FIELD

The present invention relates to apparatus for cleaning the interior of tubes and tube bundles. More specifically, the present invention relates to tube cleaning apparatus using fluid cleaning lances.

DESCRIPTION OF THE PRIOR ART

Tubing, tube bundles and, in particular, tube bundles used in heat exchangers often become partially or completely blocked with material and must be cleaned.

In one method, cleaning nozzles which spray pressurized fluids were mounted on hollow lances which conveyed the pressurized fluid to the nozzles. The lances were moved in and out of the tubes to clean them. Such fluid pressure tube cleaning systems are disclosed in U.S. Pat. Nos. 3,817,262; 3,901,252; 3,903,912; 3,938,535; 3,736,909; 3,377,026; 3,246,660; 2,494,380; 3,794,051; 620,224; 3,269,659 and 3,987,963. In some systems, such as those disclosed in U.S. Pat. Nos. 3,246,847; 3,791,583 and 4,137,928, the pressurized fluid was also used to provide reciprocal motion to the lance.

As is generally the case with high power reciprocating systems, the stopping of the motion in each direction was a source of problem and wear on the systems. This was especially true when the arresting of the moving lance was performed by direct physical contact. This high velocity metal on metal contact jolted the system and caused wear.

SUMMARY OF THE INVENTION

With the present invention, the destructive force of the reciprocating lance motion, whether rearward or forward, in a fluid powered cleaning lance system is reduced by the addition of apparatus to dampen the velocity of the lance at the time the motion is reversed. The rearward motion is dampened by a reservoir portion between the fluid outlet and the lance housing back end acting as a hydraulic stop.

The forward motion is dampened by a forward motion arresting means. A plug member is mounted around the lance. The plug member has an outer surface which allows fluid flow around the plug member within the lance housing. A body member with fluid passages is loosely mounted about the lance between the plug member and the fluid inlet. The lance moving forward causes the plug member to meet the body member and forms blocking means which substantially reduces the fluid flow area and dampens the forward motion of the lance. A spring is placed between the body member and the forward end of the lance housing in an embodiment to provide further dampening of the forward motion.

DESCRIPTION OF THE PREFERRED EMBODIMENT

Figure 2:
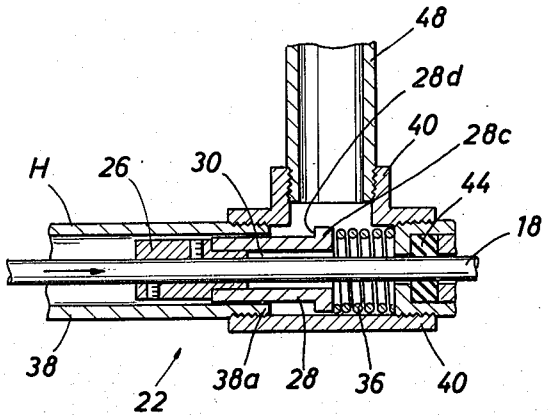
FIG. 2 is a cross-sectional view of part of the present invention near the end of the lance forward motion.
Figure 1:
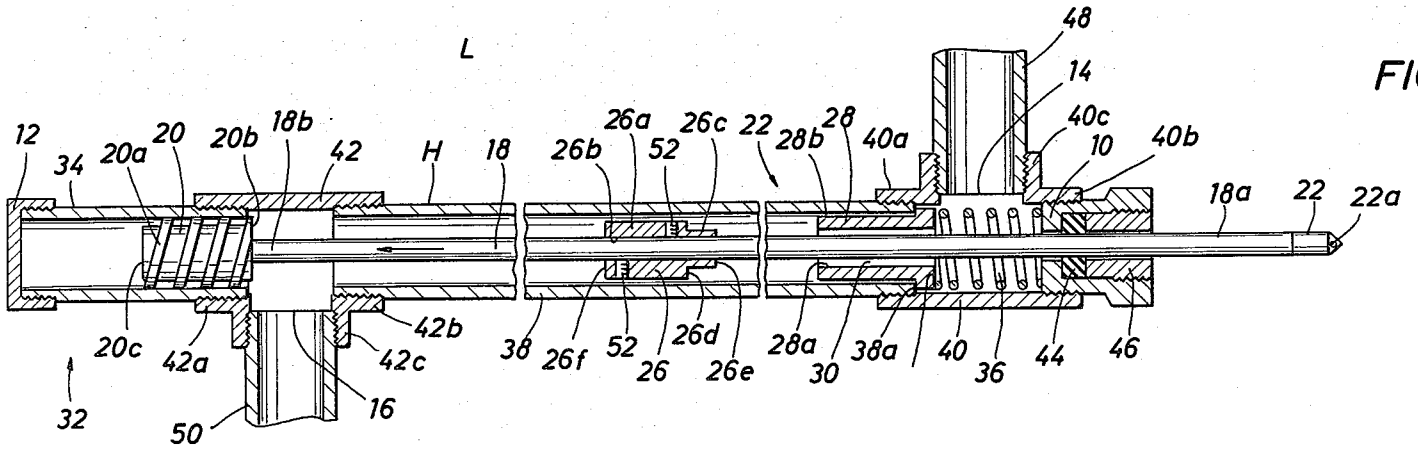
FIG. 1 is a cross-sectional view of the present invention near the end of the lance rearward motion.

Referring to the drawings, FIG. 1 shows a power lance assembly L. A hollow cleaning lance 18 is mounted in a housing H for reciprocal sliding motion through a housing front end 10 responsive to fluid pressure in the housing H on a piston 20 mounted adjacent to a lance rearward end 18*b* within the housing H. A cleaning nozzle 22 is mounted on a lance forward end 18*a* outside of the housing H. Forward motion arresting means 24 mounted in the housing H includes a plug member 26 mounted with the lance 18 and a body member 28, with a fluid passage 30, mounted loosely about the lance 18 between the plug member 28 and a fluid inlet 14. As shown in FIG. 2, when the plug member 26 is in contact with the body member 28, they form a blocking means which substantially prevents fluid flow within the housing H, which dampens the forward motion of the lance 18. A resilient force absorbing means 36, such as a spring or the like, is mounted between the body member 28 and the housing front end 10 to further absorb the forward motion of the lance 18. Rearward motion arresting means 32 includes a reservoir portion 34, between a fluid outlet 16 and a housing back end 12, which receives fluid to act to dampen the rearward motion of the lance 18 and piston 20.

The generally cylindrical housing H, which is shown as being similar to the apparatus disclosed in U.S. Pat. No. 4,137,928, of which Applicant is owner, includes a back end 12 which is a cap securely, threadedly engaged to the cylindrical reservoir portion 34. The reservoir portion 34 is threadedly engaged to an outlet T-connection 42 by a fitting 42*a*. An outlet T-connection fitting portion 42*b* is, in turn, threadedly engaged to one end of a cylindrical main housing portion 38. The main housing portion 38 is threadedly engaged, at its other end, to an inlet T-connection 40 at a fitting 40*a*. An inlet T-connection fitting 40*b* is securely engaged to front end 10. The fluid pressure is maintained in the housing H despite the lance sliding movement through the front end 10 by a stuffing 44 held by a retainer fitting 46 which also acts as a supporting guide for the lance 18. Pressurized fluid, to drive the lance 18, is supplied to the housing H by a pressure hose 48 which is threadedly connected at a fitting 40*c* to the inlet 14 adjacent the forward end 10. The pressure hose 48 is connected to a source of pressurized fluid (not shown). A hose 50 is connected to the outlet 16 at a fitting 42*c* and leads to a drain. Flow through the hose 50 is controlled by a valve (not shown) in the manner of U.S. Pat. No. 4,137,928 previously referred to.

Lance 18 is a hollow steel tube of strength sufficient to contain sufficient fluid under pressure to clean blocked tubing. Nozzle 22 is mounted on the forward end 18*a* and has spray holes 22*a* whereby the pressurized fluid from the lance interior may spray into the tube to be cleaned. The piston 20 mounted upon the rearward end 18*b* of the lance 18 and has an opening means (not shown) to allow fluid from the housing H to enter into the hollow lance 18. Spiral portions 20*a* are formed on the piston 20 to give the lance 18 a rotating motion to aid in cleaning of tubes.

The plug member 26 of forward motion arresting means 24 is, in the preferred embodiment, a cylinder with an outer surface 26*a*, an inner surface 26*b*, a radially reduced portion 26*c* forming a shoulder 26*d*, a forward surface 26*e* and a rearward surface 26*f*. The inner diameter of the plug member 26 is that of the outer diameter of the lance 18 so that they snugly fit together. The holding screws 52 mount the plug member 26 securely upon the lance 18. The selected position on the lance 18 that the screws 52 mount the plug member 26 limits extension of the nozzle 52.

The body member 28 is preferably a cylinder or tubular member with an inner diameter significantly larger than the lance 18 so that the fluid passage 30 is formed between the lance 18 outer diameter and the cylinder inner surface 28*a*. The cylinder outer diameter is such that an outer surface 28*b* is in proximity to the housing H inner surface. A radially enlarged lip portion 28*c* forms a shoulder 28*d* which in conjunction with the shoulder formed by main housing portion forward end 38*a* restricts the rearward motion of body member 28 in response to fluid pressure and positions the body member 28 adjacent the fluid inlet 14. As seen in FIG. 2, the radially reduced portion 26*c* of the plug member 26 is adapted to fit within the fluid passage 30 of the body member 28 and, thereby, form blocking means when in contact which substantially prevents fluid flow within the housing H. Other shapes for the contacting surfaces, such as conically tapered or flat, may be used to form the blocking means.

In operation of the power lance assembly L, the valve attached to the hose 50 is opened so that fluid may flow outward. Fluid entering the housing H through the inlet 14 flows through the fluid passage 30, past the plug member 26 and, acting upon the piston forward surface 20*b*, forces the piston 20 and the lance 18 rearward towards the housing back end 12. As the piston 20 passes the fluid outlet 16 and enters into the reservoir portion 34, the fluid in the reservoir portion 34 acts as a hydraulic stop to dampen the rearward motion of the lance 18 and significantly reduces the momentum of the piston 20 prior to reaching the back end 12.

To cause the lance 18 to have forward motion, the valve in the hose 50 is closed. The fluid pressure then acts on the piston rearward surface 20*c* to urge the lance 18 forward and into the tube to be cleaned. As the lance 18 reaches its forward position, the plug member 26 approaches the cylindrical body member 28. The radially reduced portion 26*c* enters into the fluid passage 30, substantially preventing all fluid flow momentarily. There is, therefore, considerably less pressure behind the plug member 26 than in front of the body member 28. As the plug member 26, engaged with the body member 28 proceeds forward, the pressure differential acting upon the surface 26*e* reduces the forward momentum of lance 18 and eventually forces the plug member 26 to disengage from the fluid passage 30, thereby reversing the motion of the lance 18. Resilient force absorbing means 26 which is shown as a coiled spring provides additional dampening of the forward motion reducing, greatly lessening or avoiding any possible destructive force upon the housing forward end 10.

The foregoing disclosure and description of the invention are illustrative and explanatory thereof and various changes in the size, shape and materials as well as the details of the illustrated construction may be made without departing from the spirit of the invention.

I claim:

1. An improved apparatus for cleaning the interior of pipes, tubes and like elongated tubular objects with pressurized fluid of the type having a housing capable of containing fluid under pressure with a front end, a back end, a fluid inlet adjacent said front end adapted to receive fluid under pressure, and a fluid outlet adjacent said back end in fluid communication with said fluid inlet; a hollow lance, with a forward end and a rearward end, mounted for reciprocal sliding motion through said housing front end responsive to fluid pressure; a piston for causing reciprocal motion of said lance responsive to fluid pressure mounted to said lance adjacent said lance rearward end within said housing; a cleaning nozzle mounted on said lance forward end outside of said housing in fluid communication with said housing through said hollow lance; wherein the improvement comprises:

a forward motion arresting means mounted in said housing to arrest the forward motion of said lance, said forward motion arresting means comprising:

a plug member mounted with said lance adapted to allow fluid flow within said housing between said plug member and an inner surface of said housing a body member with a fluid passage, loosely mounted about said lance between said plug member and said fluid inlet adapted to allow fluid flow through said fluid passage; and said plug member when in contact with said body member comprising blocking means for substantially preventing fluid flow within said housing thereby dampening the forward motion of said lance.

2. The apparatus of claim 1, wherein said forward motion arresting means further comprises:

a resilient force absorbing means mounted about said lance between said body member and said housing front end.

3. The apparatus of claim 1, wherein:

said plug member has a radially reduced portion adapted to engage said body member fluid passage.

4. The apparatus of claim 3, wherein:

said plug member is adjustably mounted on said lance to control the length of said lance extendable from said housing.

5. The apparatus of claim 3, wherein:

said body member is generally cylindrical.

6. The apparatus of claim 4, further comprising:

positioning means to position said body member adjacent said fluid inlet.

7. The apparatus of claim 1, 2, 3, 4, 5 or 6, including a rearward motion arresting means, comprising:

a reservoir portion between said fluid outlet and said housing back end to receive fluid to act to dampen rearward motion of said lance.

* * * * *